US006608967B1

(12) United States Patent
Arrison

(10) Patent No.: US 6,608,967 B1
(45) Date of Patent: Aug. 19, 2003

(54) METHOD AND APPARATUS FOR FRACTURING BRITTLE MATERIALS BY THERMAL STRESSING

(76) Inventor: Norman L. Arrison, 11412-102 Avenue, Edmonton, Alberta (CA), T5K 0P9

( * ) Notice: Subject to any disclaimer, the term of this patent is extended or adjusted under 35 U.S.C. 154(b) by 147 days.

(21) Appl. No.: 09/588,544

(22) Filed: Jun. 7, 2000

Related U.S. Application Data

(60) Provisional application No. 60/137,731, filed on Jun. 7, 1999.

(51) Int. Cl.[7] ..... H05B 3/00; E21C 37/20

(52) U.S. Cl. ..... 392/407; 299/14; 175/16; 241/1; 225/93.5

(58) Field of Search ..... 392/407, 408, 392/421, 422; 299/14; 175/11, 16; 241/1; 606/2.5; 125/2; 225/93.5; 405/131

(56) References Cited

U.S. PATENT DOCUMENTS

| | | | | | |
|---|---|---|---|---|---|
| 914,636 | A | * | 3/1909 | Case | 299/56 |
| 1,679,857 | A | * | 8/1928 | France | 241/1 |
| 2,703,360 | A | * | 3/1955 | Lipscomb | 362/225 |
| 3,520,455 | A | * | 7/1970 | Smith | 225/93.5 |
| 3,556,366 | A | * | 1/1971 | Kim | |
| 3,589,883 | A | * | 6/1971 | Dear | 225/93.5 |
| 3,695,497 | A | * | 10/1972 | Dear | 392/421 |
| 3,751,657 | A | * | 8/1973 | Sangiamo et al. | 362/294 |
| 3,797,757 | A | * | 3/1974 | Marshall | 225/93.5 |
| 3,826,537 | A | * | 7/1974 | Boyd et al. | 299/14 |
| 3,860,903 | A | * | 1/1975 | Steenhoven | 362/279 |
| 4,027,185 | A | | 5/1977 | Nodwell et al. | |
| 4,109,144 | A | * | 8/1978 | Vidmar | 362/247 |
| 4,201,921 | A | | 5/1980 | McCorkle | |
| 4,700,102 | A | | 10/1987 | Camm et al. | |
| 4,937,490 | A | | 6/1990 | Camm et al. | |
| 5,336,842 | A | * | 8/1994 | Massholder et al. | 588/227 |
| 5,561,735 | A | | 10/1996 | Camm | |
| 5,818,649 | A | | 10/1998 | Anderson | |
| 5,966,836 | A | * | 10/1999 | Valdez, III et al. | 34/448 |
| 6,226,454 | B1 | * | 5/2001 | Couture | 392/419 |

FOREIGN PATENT DOCUMENTS

| | | | | |
|---|---|---|---|---|
| CA | 1015817 | | 8/1977 | |
| EP | 397236 | * | 11/1990 | 225/93.5 |
| JP | 61-242273 | * | 10/1986 | 175/16 |
| JP | 1-137515 | * | 3/1989 | |
| SU | 829931 | * | 5/1981 | 299/14 |
| SU | 831956 | * | 5/1981 | 299/14 |

OTHER PUBLICATIONS

Clark, George B., "Rock Disintegration—the Key to Mining Progress," Mining Engr, V. 23, No. 3, pp. 47–51, Mar. 1971.*

* cited by examiner

*Primary Examiner*—John A. Jeffery
(74) *Attorney, Agent, or Firm*—Bennett Jones LLP

(57) ABSTRACT

A method of fracturing or breaking rock includes the step of directing high intensity white light at the rock to induce thermal stress sufficient to fracture the rock. An approach for generating high intensity white light includes an elongate arc chamber and an elongate concave reflector. The arc chamber and reflector may be shielded from airborne particulate matter by an air shield or a rotating or reciprocating translucent shield.

3 Claims, 4 Drawing Sheets

METHOD AND APPARATUS FOR FRACTURING BRITTLE MATERIALS BY THERMAL STRESSING

CROSS REFERENCE TO RELATED APPLICATION

The present application claims priority to U.S. Provisional Patent Application Serial No. 60/137,731 filed on Jun. 7, 1999, entitled "Method And Apparatus For Fracturing Brittle Materials By Thermal Stressing".

FIELD OF THE INVENTION

The present invention relates to methods and apparatus for fracturing rock, ceramics, concrete and other materials of low elasticity. The invention relates in particular to methods and apparatus for fracturing rock for purposes of mining, excavation, and demolition.

BACKGROUND OF THE INVENTION

Mining and excavation of rock is commonly carried out using explosives. Typically, sticks of explosive are placed in holes drilled into the rock and then detonated, thereby explosively fragmenting a portion of the rockface being worked on. The rock debris created by the explosion is cleared away, and preparations begin for another blast.

The blasting method described above is time-consuming and expensive. Each blast takes a considerable time to set up and carry out. A large number of holes must be drilled into the rockface, then the explosives placed in the holes must be carefully interconnected with fusing apparatus to ensure that they detonate simultaneously. The resultant blast can throw rock debris large distances, unless the configuration of the blast is such that heavy and expensive blasting mats can be put in place to cushion the explosion and prevent the blast debris from flying away. As with any operation employing explosives, the blasting method also is inherently hazardous to the persons involved.

Accordingly, there is a need for rock mining and excavation methods which are faster and more efficient and thus less expensive than conventional blasting methods. There is also a need for rock mining and excavation methods which eliminate or substantially reduce the safety hazards associated with conventional rock blasting practices.

One possible alternative to conventional mining methods is to fracture the rock by means of thermal stress. It is well known that solid materials can fracture due to internal stresses induced by a large and sudden temperature change. A simple example of this is the shattering of a piece of glassware plunged into cold water after having been heated. Similarly, rock will shatter if it undergoes a temperature rise great enough and sudden enough to induce internal tensile stresses exceeding the inherent tensile strength of the rock. This would be a desirable result for purposes of rock mining and excavation. Material near the surface of a rock mass would be heated rapidly, and resultant thermal stresses would fracture the rock. The fractured material would be removed, then the process would be repeated on the fresh rock thus exposed, and so on until a desired amount of rock has been removed.

The practical difficulty with this concept, of course, is how to create such a sufficiently sharp and intense temperature rise in the surficial zone of a rock mass, before the heat thus transferred to the rock can be dissipated by conduction throughout the rest of the rock mass. One obvious aspect of the solution is to use an extremely hot source of heat.

Conventional flame-heat sources, however, are not capable of achieving the desired result. An acetylene-oxygen flame, for example, can achieve a maximum temperature of approximately 3,100 degrees Celsius, but tests have indicated that even a flame this hot is not effective for producing thermal stresses intense enough to fracture rock.

U.S. Pat. No. 4,027,185 issued to Nodwell et al. on May 31, 1977, U.S. Pat. No. 4,700,102 issued to Camm et al. on Oct. 13, 1987, and U.S. Pat. No. 4,937,490 issued to Camm et al. on Jun. 26, 1990, the contents of which are incorporated herein by reference, disclose closely similar arc lamps capable of generating white light at temperatures as high as 12,000 degrees Celsius, considerably hotter than the temperatures which can be achieved with flame heat. These arc lamps have been developed and used for such applications as simulating, for purposes of scientific experiments, the high temperatures produced by nuclear explosions. The white light generated by these arc lamps is hot enough to heat rock high enough and quickly enough to produce thermal-stress-induced fracture, and in fact is capable of heating an object a great deal faster than a flame source.

This can be illustrated by the well-established heat transfer equation for radiant heat, as follows:

$$Q=\sigma E\ F\ A\ (T_1^4-T_2^4)$$

wherein:

Q=amount of heat transferred

σ=Stefan-Boltzmann constant

E=emissivity

F=shape factor

A=area $T_1$=temperature of heat source $T_2$=initial temperature of heat absorber (i.e., object being heated)

This equation may be used to compare the amounts of heat transferred to an object by a white light source and by a flame source. Factors σ, E, F, and A will be constant for each case. Given that $T_1$ will be far greater than $T_2$ in either case, it is evident on inspection that the term $(T_1^4-T_2^4)$ may be reduced to merely $T_1^4$ without significant loss of accuracy. It follows, therefore, that:

$$Q_L/Q_F=T_{IL}^4/T_{IF}^4=(T_{IL}/T_{IF})^4$$

where:

$Q_L$=amount of heat transferred to heat absorber by light source $Q_F$=amount of heat transferred to heat absorber by flame source $T_{IL}$=temperature of light source $T_{IF}$=temperature of flame source Therefore, if the temperature of the light source is 12,000 degrees Celsius, and the temperature of the flame source is 3,100 degrees Celsius, the heat transfer from the light source will be $(12{,}000/3{,}100)^4$ or 225 times that of the flame source.

White light arc lamps of the type taught by Nodwell et al. and Camm et al. feature a hollow, elongate quartz arc chamber positioned within an elongate concave reflector. The reflector is hollow, so that liquid coolant may be circulated through the reflector to prevent it from becoming overheated under the intense heat generated by the arc chamber. For proper operation, this type of arc lamp requires an extremely clean environment. Even tiny amounts of dust or dirt on the quartz arc chamber or the reflector can cause the lamp to fail, or to function with significantly reduced effectiveness.

For these reasons, white light arc lamps have typically been used only in controlled environments such as experimental laboratories. If used, unmodified, for thermal-stress-induced fracturing of rock, they would likely malfunction because of the dirty air typically associated with rock mining and excavation operations. One apparent possible solution to this problem would be to enclose the arc chamber and reflector inside a translucent cover, thereby shielding them from airborne particles while allowing light to pass through. The solution cannot be quite this simple, however; airborne particles would build up on the cover, melt under the intense heat from the lamp, and interfere with the transmission of light from the lamp. Therefore, any cover over the arc chamber and reflector would have to be kept extremely clean, even in a dirty environment.

Accordingly, there is a need for an improved white light arc lamp, the arc chamber and reflector of which will remain clean and effectively dust-free even in environments having significant concentrations of airborne particulate matter. As well, there is a need for an improved white light arc lamp having means for keeping the arc chamber and reflector clean in dirty environments while also ensuring effectively unimpeded transmission of light from the arc lamp to a target object.

BRIEF SUMMARY OF THE INVENTION

In one aspect, the present invention is the use of high-intensity white light to induce thermal stress fracture in brittle materials such as rock, ceramics or concrete. In another aspect, the present invention is a method of fracturing brittle materials such as rock, ceramics or concrete, comprising the step of directing white light generated by a high-intensity arc lamp upon a mass of the brittle material until the material fractures due to induced thermal stresses.

In another aspect of the invention, the invention comprises a high intensity arc lamp for generating and directing high intensity light toward a target object, said arc lamp having an arc chamber and comprising:

(a) a convex reflector enclosure which partially encloses the arc chamber and which comprises an air inlet;

(b) an air plenum associated with the enclosure;

(b) a source of air for introduction into the air plenum;

(c) filtering means for filtering particulate matter from the air before it is introduced into the air plenum;

(d) a fan for forcing air from the air plenum through the air inlet segmented reflector and past the arc chamber, so as to create an air shield travelling outwardly away from the arc chamber and the reflector and deflecting airborne particulate matter away from the arc chamber and the reflector; and (e) cooling means for cooling the reflector and peripheral surfaces of the air plenum.

Preferably, the convex reflector is divided into at least two segments which are spaced apart and the air inlet is the space(s) between the segments of the reflector. More preferably, the convex reflector comprises at least three longitudinal segments thereby providing at least two longitudinal air inlets between the longitudinal segments.

In another aspect, the invention comprises an apparatus for shielding the arc chamber and reflector against the entry and build-up of airborne particulate matter, for use in a high-intensity arc lamp having an elongate arc chamber positioned within an elongate concave reflector, said apparatus comprising:

(a) a translucent cylindrical shield mounted to the arc lamp so as to encircle and enclose the arc chamber and reflector, with the longitudinal axes of the translucent cylindrical shield and the arc chamber being substantially coincident or parallel;

(b) means for rotating the translucent cylindrical shield about its longitudinal axis; and (c) means for continuously cleaning the surfaces of the translucent cylindrical shield as it rotates.

In yet another aspect, the invention comprises an apparatus for shielding the arc chamber and reflector against the entry and build-up of airborne particulate matter in a high-intensity arc lamp having an elongate arc chamber positioned within an elongate concave reflector, said apparatus comprising:

(a) a first shield chamber associated with one longitudinal edge of the reflector;

(b) a second shield chamber associated with the other longitudinal edge of the concave reflector;

(c) a translucent planar shield approximately as long and slightly more than twice as wide as the open side of the reflector, and positioned such that it completely closes off the open side of the reflector, thereby enclosing the arc chamber, and such that the portion of the translucent planar shield not thus positioned across the open side of the reflector at a given time will be housed within either the first or second shield chamber;

(d) means for moving the translucent planar shield in a reciprocating fashion in its own plane, such that it alternately extends partially into the first shield chamber and then partially into the second shield chamber while at all times being positioned across and closing off the open side of the reflector and enclosing the arc chamber;

(e) means within the first shield chamber and second shield chamber for cleaning the surfaces of the translucent planar shield as it moves alternately into or out of the first and second shield chambers.

BRIEF DESCRIPTION OF THE DRAWINGS

Embodiments of the invention will now be described with reference to the accompanying drawings, in which numerical references denote like parts, and in which.

DETAILED DESCRIPTION OF THE INVENTION

Figure 1:
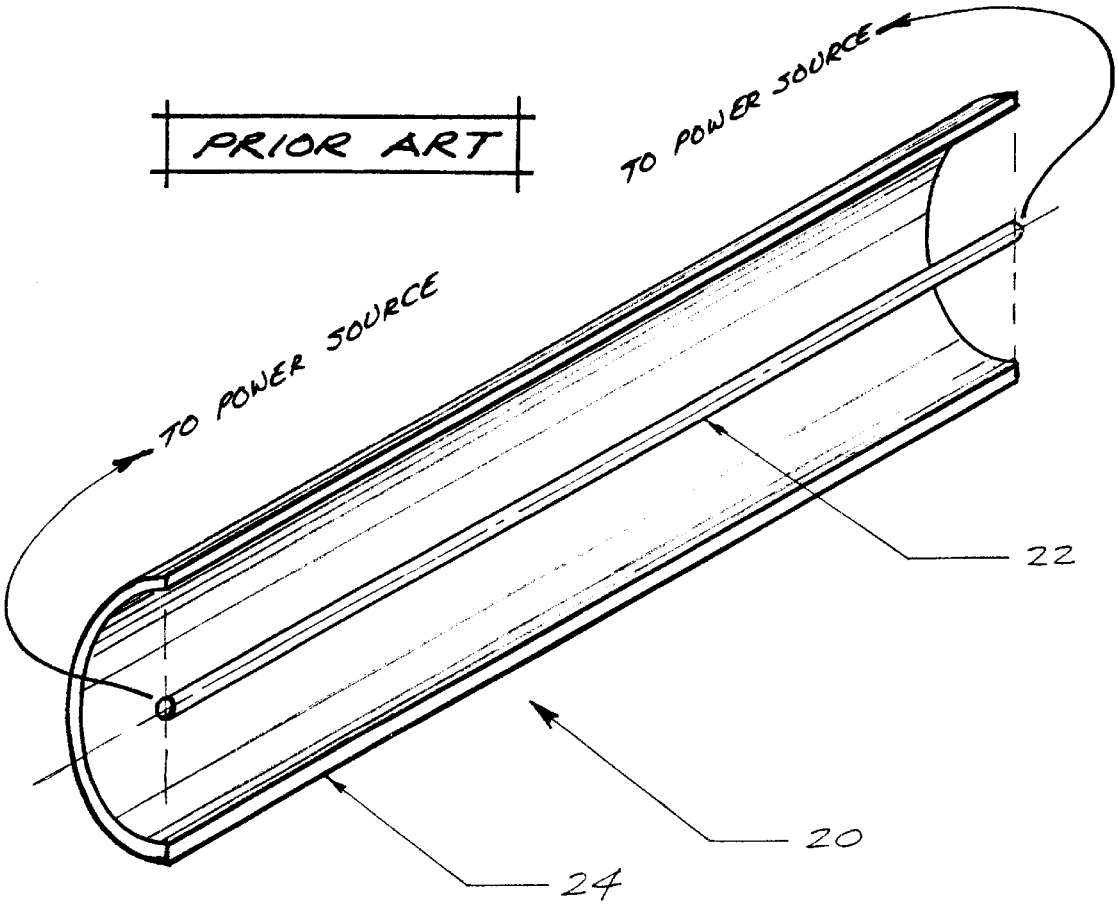
FIG. 1 is a schematic isometric drawing of a high-intensity arc lamp known in the prior art.

FIG. 1 schematically depicts a high-intensity arc lamp (also called a "white light lamp") known in the prior art, generally indicated by the reference number (20). This device has an elongate light bulb referred to as an arc chamber (22), and a concave reflector (24) disposed substantially co-axially around the arc chamber (22). Light generated by the arc chamber (22) is focussed by and reflected outwardly from the reflector (24). The arc chamber comprises a cylindrical quartz tube within which a high intensity arc discharge between two electrodes is provided. Such arc chambers (22) are well known in the art. Suitable arc chambers may be as described in the Nodwell, et al. and Camm, et al. patents referred to above or may be available from Vortek Industries, Vancouver, British Columbia.

The reflector (24) directs the light to the target and must be water cooled to withstand the heat generated by the arc chamber. In one embodiment, the reflector defines internal water cooling passages (not shown) and baffles designed to allow water to flow through the reflector and cool the reflector.

Arc lamps having arc chambers which generate sufficient radiant heat energy may be used to fracture rocks. The lamp may be positioned close to the rock or rock surface which is to be fractured and turned on until the rock fractures. The distance from the lamp to the rock and the focus of the light may be adjusted to suit the needs of the application. In one embodiment, the distance between the arc chamber and the surface of the rock to be fractured may be about 10 centimeters to about 100 cm or more. The distance will depend on the size and susceptibility to heat stress of the rock, the power of the arc lamp and the length of time of exposure. The time of exposure may vary from a few seconds to 30 minutes or more.

As referred to above, it is very important to keep particulate matter such as dust and debris away from the arc chamber (22) and reflector (24). In one embodiment, this is accomplished by flowing a clean air stream past the reflector and arc chamber as an air shield so that dust and debris cannot get to the arc chamber and reflector.

Figure 2:
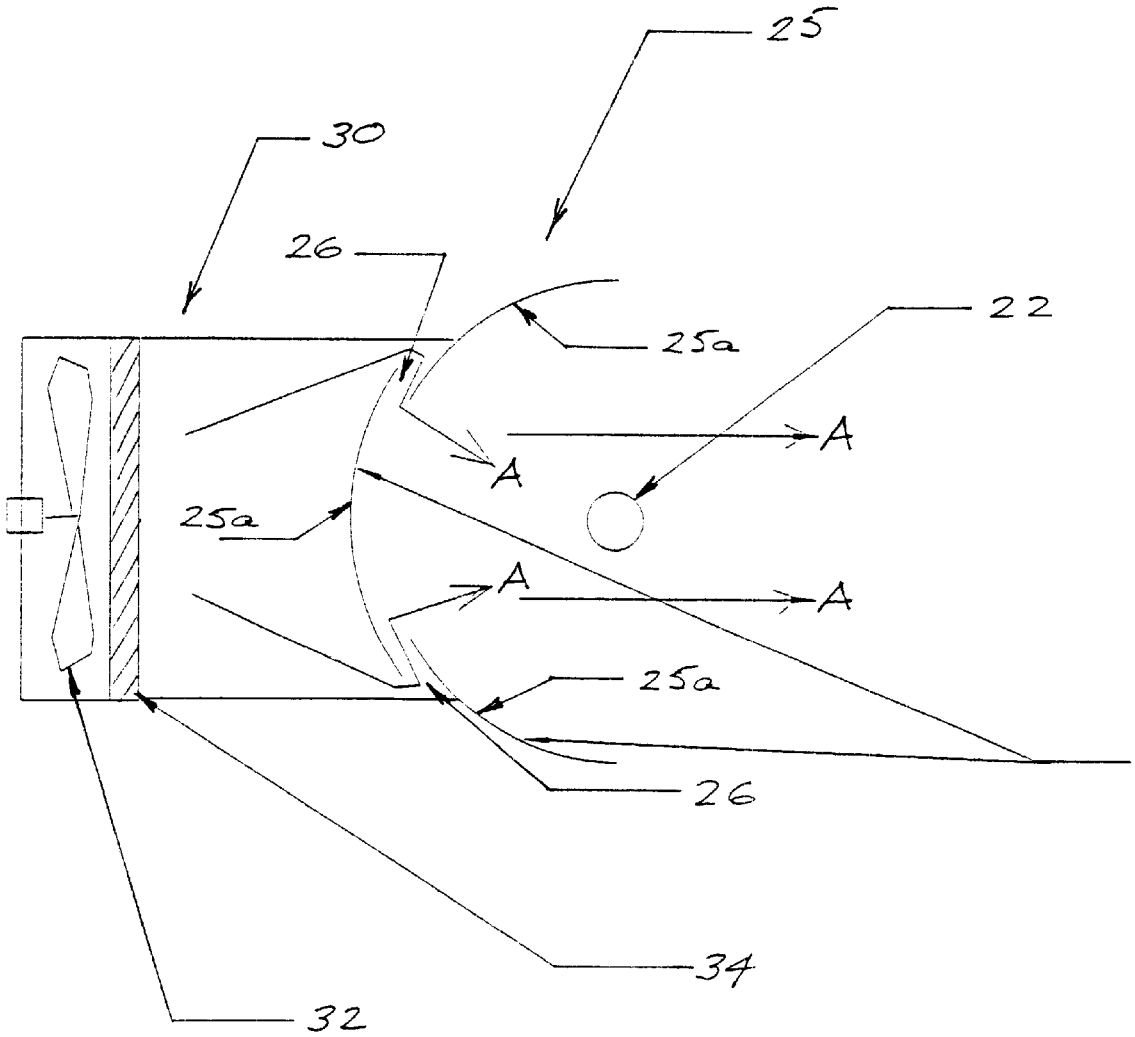
FIG. 2 is a schematic drawing of a high-intensity arc lamp equipped with the air shield and reflector apparatus of the present invention.

FIG. 2 conceptually illustrates one embodiment of an air shield apparatus of the present invention, being a modification of the prior art high-intensity arc lamp described above. This apparatus has a segmented reflector (25) made with a number of reflector segments (25*a*) which define air passages (26) between them. An air plenum (30) positioned behind the segmented reflector (25) carries air from a compressed air source (not shown). The air is forced through the air passages (26), and is directed over, around, and outwardly away from the arc chamber (22), all as conceptually indicated by arrows "A". The air is forced over, around, and away from the arc chamber (22) with sufficient velocity to deflect airborne particulate matter away from the arc lamp and thus to prevent such matter from coming in contact with the arc chamber (22).

In the preferred embodiment, a fan (32) is provided to increase the velocity of the air flowing through the air plenum (30). As well, an air filter (34) is interposed between the plenum (30) and the fan (32) in order to minimize or eliminate particulate matter which might be present in the compressed air, and which otherwise might come into contact with the arc chamber (22) and impair its function. Also in the preferred embodiment, cooling means (not shown) will be provided in association with the air plenum (30) to cool the air passing therethrough, so as to provide enhanced cooling of the segmented reflector (25) and the arc chamber (22).

In an alternative embodiment utilizing the air shield (not shown), the reflector may be unitary and air may be flowed past the reflector and arc chamber along the longitudinal axis of arc chamber. The specific direction of air flow is unimportant so long as clean or filtered air flows past the reflector and arc chamber and ultimately towards the potential source of dust or debris so that the air stream acts as a shield.

In another aspect of the invention, the arc lamp may be shielded from dust and debris by a transparent shield. However, as noted above, the arc lamp must be modified to keep the shield clean and free of dust and debris.

Figure 3:
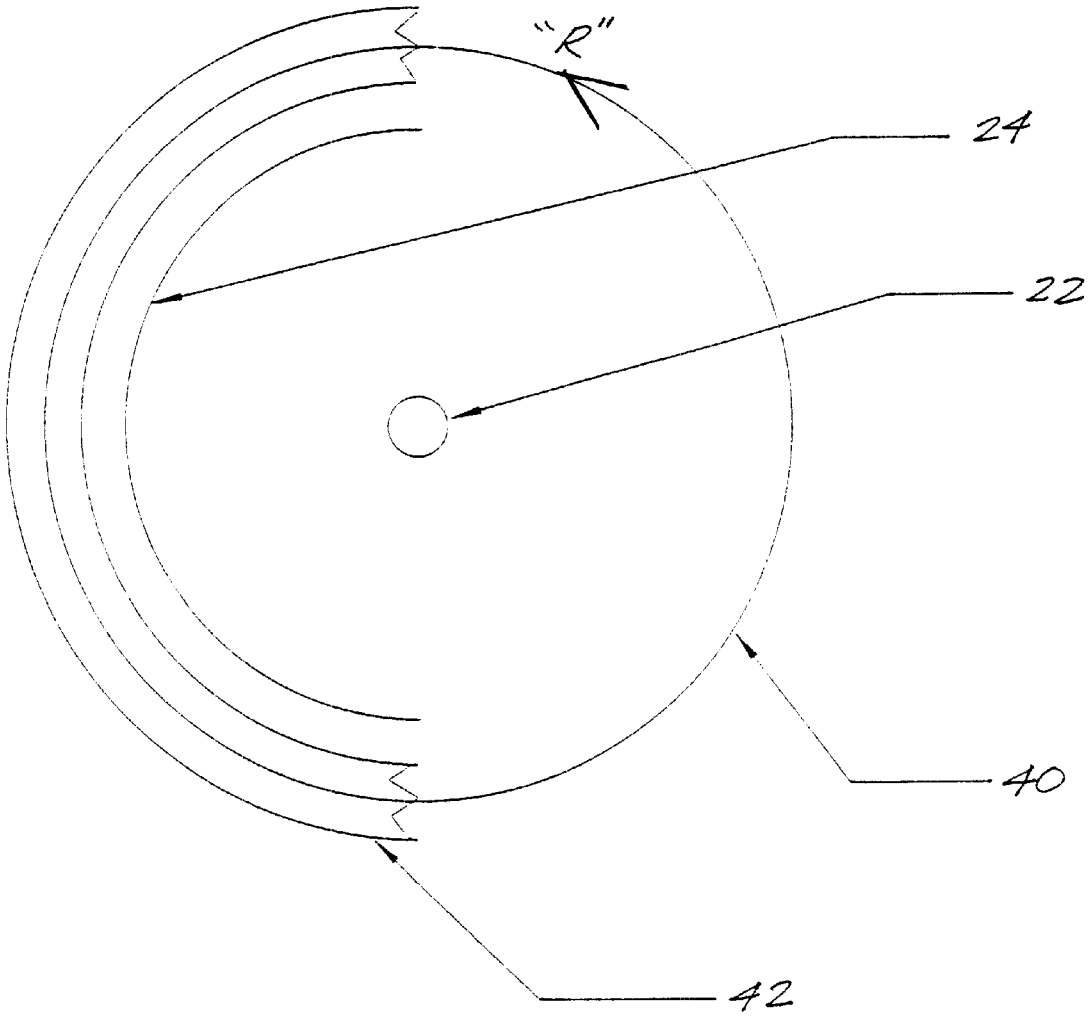
FIG. 3 is a schematic drawing of a high-intensity arc lamp equipped with an embodiment of the translucent cylindrical shield apparatus of the present invention.

FIG. 3 illustrates an embodiment of this aspect of the present invention, in which a high-intensity arc lamp, having an arc chamber (22) and a water-cooled reflector (24), is fitted with a translucent cylindrical shield (40). The cylindrical shield (40) is mounted to the arc lamp so as to enclose, and to rotate substantially coaxially around, the arc chamber (22) and the reflector (24). As it rotates, the cylindrical shield (40) passes continuously through a shield-cleaning chamber (42) formed between two semi-cylindrical members (41*a*, 41*b*). FIG. 3 shows the cylindrical shield (40) rotating counterclockwise, as indicated by arrow "R", but it could be rotating clockwise with substantially the same effectiveness. Also, the cylindrical shield (40) need not rotate continuously in one direction. In one embodiment, the cylindrical shield may stop and reverse itself after making a full turn or a half turn. The object is to periodically clean the shield in the cleaning chamber (42) and to return it in position in front of the arc lamp. The speed of rotation may be varied in accordance with the conditions. In extremely dirty conditions, it may be necessary to rotate the shield (40) at a higher speed.

The cylindrical shield (40) provides a physical barrier preventing airborne particulate matter from coming in contact with the arc chamber (22). Undesirable accumulation of particulate matter on the cylindrical shield (40) is prevented or minimized by the continuous cleaning action of the shield-cleaning chamber (42). Disposed within the cleaning chamber (42) may be cleaning elements (not shown) in contact with the shield (40) such as wiper blades or soft cloths which clean the shield as it rotates within the cleaning chamber (42). The cylindrical shield may be slightly pressurized from the inside with a source of clean or filtered air so as to prevent particulate matter from entering inside the cylindrical shield. This configuration would also accommodate expansion and contraction of the air resulting from the heat generated by the arc chamber during operation.

The cylindrical shield (40) may be rotated by a chain or belt (not shown) driven by an electric or hydraulic motor or by any other suitable mechanical means for rotating the shield.

Figure 4:
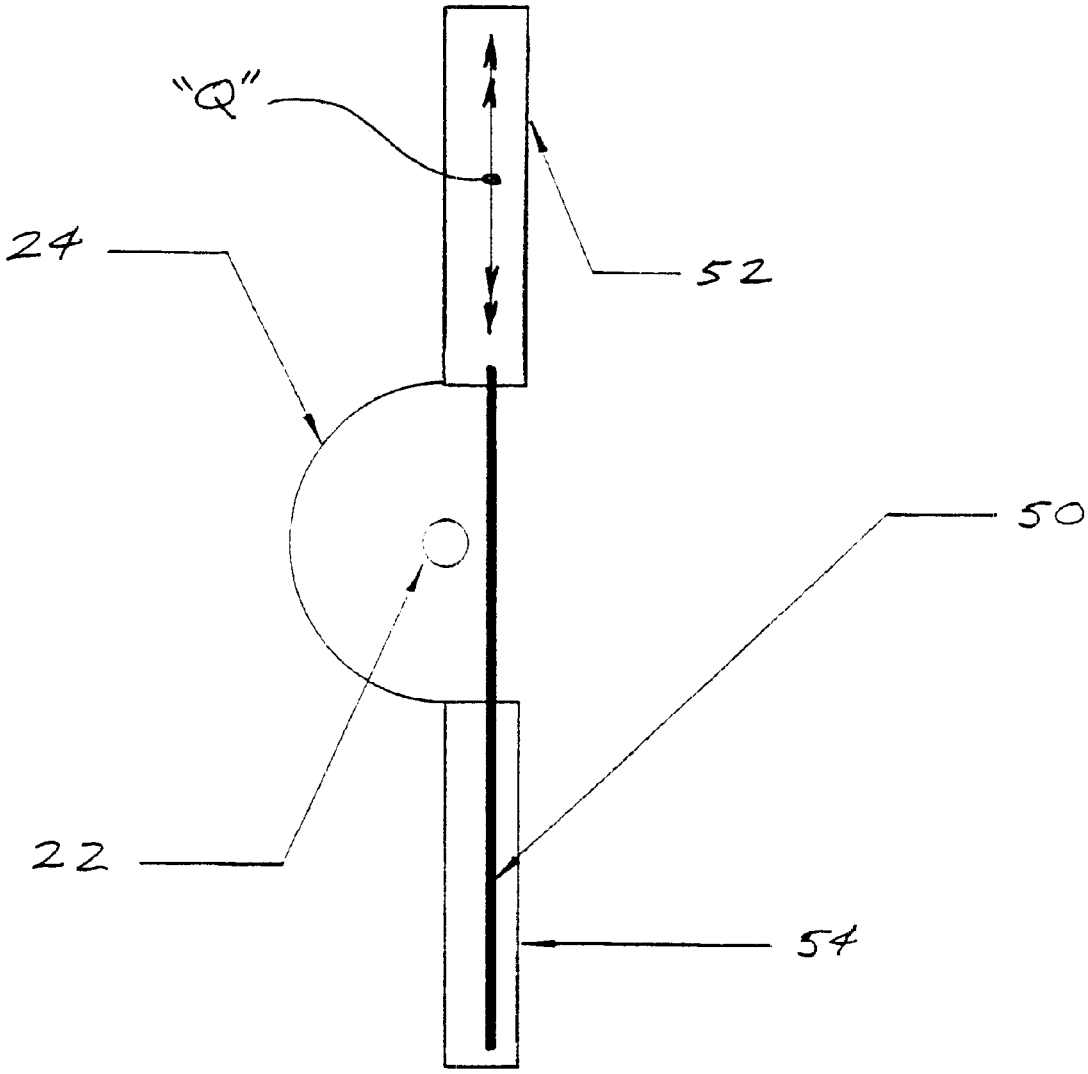
FIG. 4 is a schematic drawing of a high-intensity arc lamp equipped with an embodiment of the translucent planar shield apparatus of the present invention.

FIG. 4 illustrates a further embodiment of the shielding apparatus of the present invention. In this embodiment, a high-intensity arc lamp is fitted with an upper shield chamber (52) disposed along the upper edge of the reflector (24) of the arc lamp, plus a lower shield chamber (54) disposed along the lower edge of the reflector (24). A translucent planar shield (50) is movably positioned within continuous slots (not shown) in the upper shield chamber (52) and the lower shield chamber (54). The planar shield (50) is dimensionally configured such that it will can slide as far as possible into the upper shield chamber (52), as conceptually indicated by arrow "Q", without being fully withdrawn from the lower shield chamber (54), and vice versa. Accordingly, the planar shield (50) at all times will completely span the space between the upper and lower edges of the reflector (24), thereby shielding the arc chamber (22) from contact with airborne particulate matter, regardless of the position of the planar shield (50).

Means are provided for reciprocating the planar shield (50) between the upper and lower shield chambers (52, 54), each of which in turn includes means for cleaning the planar shield (50) as it moves in and out of the shield chambers. The shield chambers (52, 54) may include wiper blades or soft cloths (not shown) to contact and clean the shield as it reciprocates in and out of the shield chamber. The reciprocating movement of the planar shield (50) and the continuous cleaning action of the upper and lower shield chambers (52, 54) prevent or minimize undesirable accumulation of particulate matter on the planar shield (50), thereby preventing or minimizing physical interference with the transmission of light from the arc chamber (22) through the planar shield (50). As with the other embodiment, the enclosure created by the planar shield (50) may be slightly pressurized with a source of clean or filtered air to prevent ingress of particulate matter during operation.

The shield (50) may be reciprocated using any suitable mechanical means (not shown) such as an electric motor and a suitable configuration of gears to cause reciprocal vertical motion of the shield.

It will be readily seen by those skilled in the art that various modifications of the present invention may be devised without departing from the essential concept of the invention, and all such modifications and adaptations are expressly intended to be included in the scope of the claims appended hereto.

The embodiments of the invention in which an exclusive property or privilege is claimed are defined as follows:

1. A method of fracturing a brittle material, comprising the steps of:

(a) directing white light generated by a high-intensity arc lamp upon a mass of brittle material until the brittle material fractures due to induced thermal stresses; and (b) directing a stream of filtered air past the arc lamp for preventing particulate matter from settling on or within the arc lamp during a fracturing operation;

(c) wherein the arc lamp comprises a translucent shield for shielding the arc lamp against the entry and build-up of airborne particulate matter, further comprising the step of moving the shield while simultaneously cleaning the particulate matter settled on the shield.

2. The method of claim 1 wherein the shield is a planar shield and is reciprocated along its plane.

3. The method of claim 1 wherein the shield is a cylindrical shield and is rotated about its centrical axis.

* * * * *